US012098531B2

(12) United States Patent
Moore et al.

(10) Patent No.: US 12,098,531 B2
(45) Date of Patent: Sep. 24, 2024

(54) MOBILE PLUMBING TOOL FOR UNCLOGGING DRAIN PIPES WITH AIR-PRESSURIZED WATER

(71) Applicants: Nathaniel A. Moore, River Forest, IL (US); Demetrice Martin, Summit, MS (US)

(72) Inventors: Nathaniel A. Moore, River Forest, IL (US); Demetrice Martin, Summit, MS (US)

( * ) Notice: Subject to any disclaimer, the term of this patent is extended or adjusted under 35 U.S.C. 154(b) by 0 days.

(21) Appl. No.: 17/667,460

(22) Filed: Feb. 8, 2022

(65) Prior Publication Data

US 2023/0250622 A1 Aug. 10, 2023

(51) Int. Cl.
*E03C 1/308* (2006.01)

(52) U.S. Cl.
CPC ..... *E03C 1/308* (2013.01)

(58) Field of Classification Search
CPC ... B05B 1/18–185; B08B 3/00; B08B 9/0321; B08B 9/0322; E03C 1/0405; E03C 1/304–308; E03F 9/007
See application file for complete search history.

(56) References Cited

U.S. PATENT DOCUMENTS 1,745,923 A * 2/1930 Frizzell ..... E03C 1/308 4/255.06
1,994,526 A * 3/1935 McCloskey ..... E03C 1/306 4/255.06
2,187,043 A * 1/1940 MacMillan ..... E03C 1/306 4/255.02
2,267,064 A * 12/1941 Wikelund ..... E03C 1/308 4/255.03
3,936,892 A * 2/1976 Miller ..... E03C 1/30 4/696
3,937,404 A * 2/1976 Johnson ..... B08B 9/0322 4/255.09
5,384,918 A * 1/1995 Leighton ..... E03C 1/306 4/255.05
9,643,201 B2 * 5/2017 Toh ..... B05C 17/00543
9,708,804 B2 * 7/2017 Palmer, II ..... E03C 1/306
2005/0050624 A1 * 3/2005 Pangramuyen ..... E03C 1/308 4/255.01

(Continued)

FOREIGN PATENT DOCUMENTS

EP 0244811 * 11/1987 ..... E03C 1/304
GB 855370 * 11/1960 ..... E03C 1/308

*Primary Examiner* — David P Angwin
*Assistant Examiner* — Nicholas A Ros
(74) *Attorney, Agent, or Firm* — Law Office of Dorian Cartwright; Dorian Cartwright

(57) ABSTRACT

A rigid T-shaped body with a hollowed cavity is configured to intercept a drain line between a clogged portion and an unclogged portion. A first inlet on the body to receive pressurized water from a water line. A second inlet on the body to receive pressurized air from a mobile air source. The second inlet can have a smaller diameter than the first inlet. The pressurized air is mixed with the pressurized water in a chamber at an intersection of the T-shaped body to produce a pressurized air/water combination of air pressurized water droplets. A combined outlet for coupling to the clogged portion of the drain pipe to force the pressurized air/water combination to clear the clogged portion of the drain.

6 Claims, 3 Drawing Sheets

(56) References Cited

U.S. PATENT DOCUMENTS

| | | | | |
|---|---|---|---|---|
| 2007/0266485 | A1* | 11/2007 | Tackett | E03C 1/306<br>4/255.04 |
| 2012/0159700 | A1* | 6/2012 | Iacampo, Sr. | E03C 1/304<br>4/255.05 |
| 2016/0361739 | A1* | 12/2016 | Wescott | E03C 1/306 |

* cited by examiner

300

MOBILE PLUMBING TOOL FOR UNCLOGGING DRAIN PIPES WITH AIR-PRESSURIZED WATER

FIELD OF THE INVENTION

The invention relates generally to a plumbing tool, and more specifically, to a plumbing tool temporarily attached for unclogging water drains with air-pressurized water.

BACKGROUND

Plumbing systems in residential and commercial units including water lines to bring in treated water and drain lines to evacuate used discarded water to a sewer system. The drain lines collect water from sinks, showers, toilets, appliances, washing machines, rain and from other sources. From time to time a drain line can become clogged from solid objects put down the drain and build out that narrows openings within drains. As a result, water can back up throughout a drain system, and even flood a unit.

Conventional tools for unclogging drains include plungers and rodders. A plunger creates a vacuum with suction of negative force to pull on clogs. By contrast, a rodder creates a positive force to push on clogs. In other cases, chemicals are poured down the drain in an effort to dissolve clogs. Unfortunately, these conventional techniques often do not solve the problem. Rodders generate the most force by physically moving through the drain pipe, but are also large and messy, pulling sludgy debris out when recoiled.

Therefore, what is needed is a robust plumbing tool for unclogging water drains with air-pressurized water.

SUMMARY

These shortcomings are addressed by the present disclosure of systems and methods for unclogging water drains with air-pressurized water.

In one embodiment, a rigid T-shaped body with a hollowed cavity is configured to intercept a drain line between a clogged portion and an unclogged portion. A first inlet on the body to receive pressurized water from a water line. A second inlet on the body to receive pressurized air from a mobile air source. The second inlet can have a smaller diameter than the first inlet. The pressurized air is mixed with the pressurized water in a chamber at an intersection of the T-shaped body to produce a pressurized air/water combination of air pressurized water droplets.

In another embodiment, combined outlet for coupling to the clogged portion of the drain pipe to force the pressurized air/water combination to clear the clogged portion of the drain. Different screens at the combined outlet can be applied to generate different dispersion pattern for the pressurized water. In yet another embodiment, a controller automatically manages a ratio between water and air during the unclogging process.

Advantageously, clogs are more easily removed with additional force relative to water or a rodder alone.

BRIEF DESCRIPTION OF THE DRAWINGS

In the following drawings, like reference numbers are used to refer to like elements. Although the following figures depict various examples of the invention, the invention is not limited to the examples depicted in the figures.

DETAILED DESCRIPTION

The description below provides systems and methods for a plumbing tool to unclog water drains with air-pressurized water. The techniques can be applied to residential and/or commercial water drains.

One of ordinary skill in the art will recognize many additional variations made possible by the succinct description of techniques below.

I. System for Unclogging Drains (FIGS. 1-2)

Figure 1:
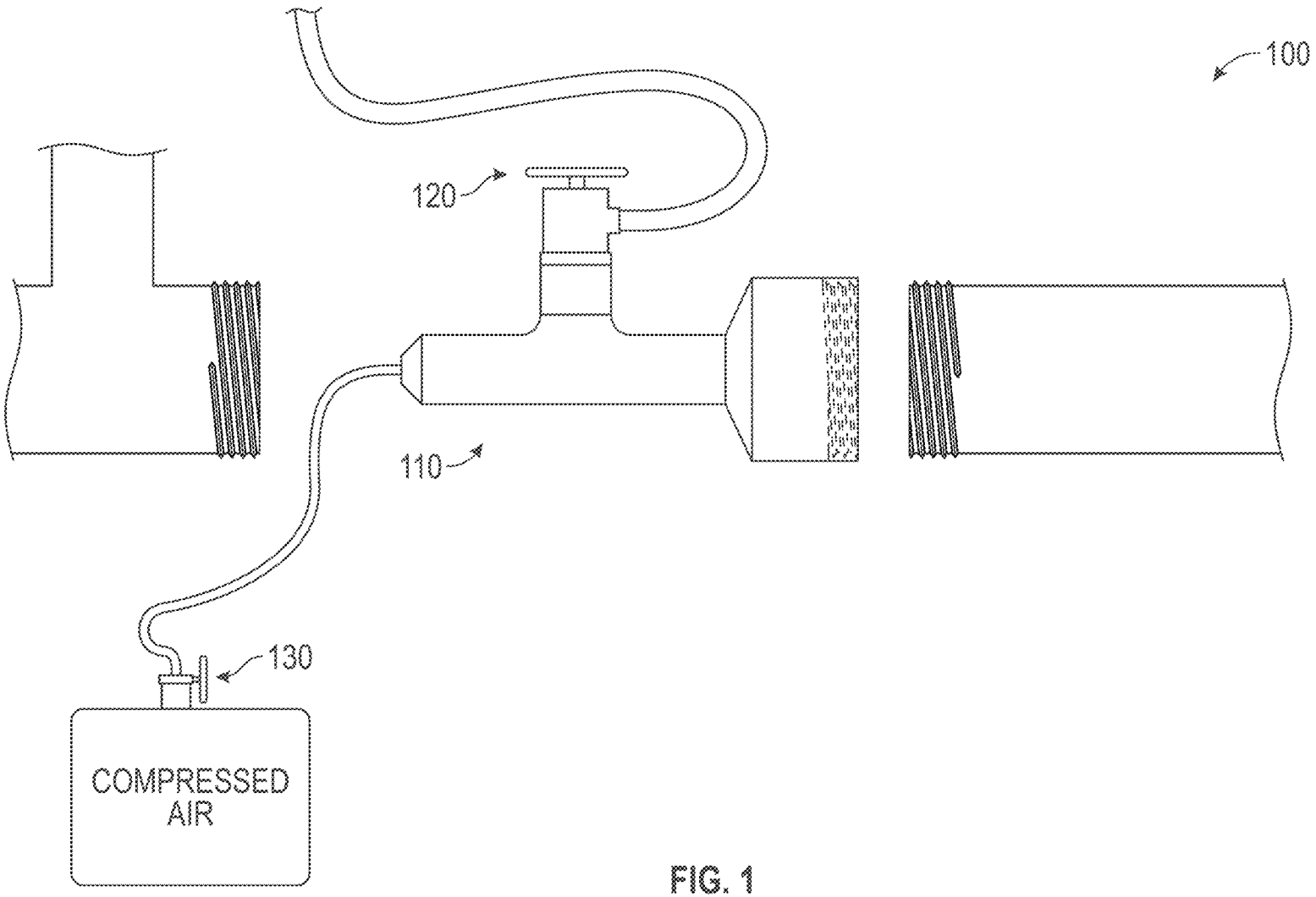
FIG. 1 is a high-level perspective diagram illustrating a plumbing tool for unclogging water drains with air-pressurized water, according to one preferred embodiment.
Figure 2:
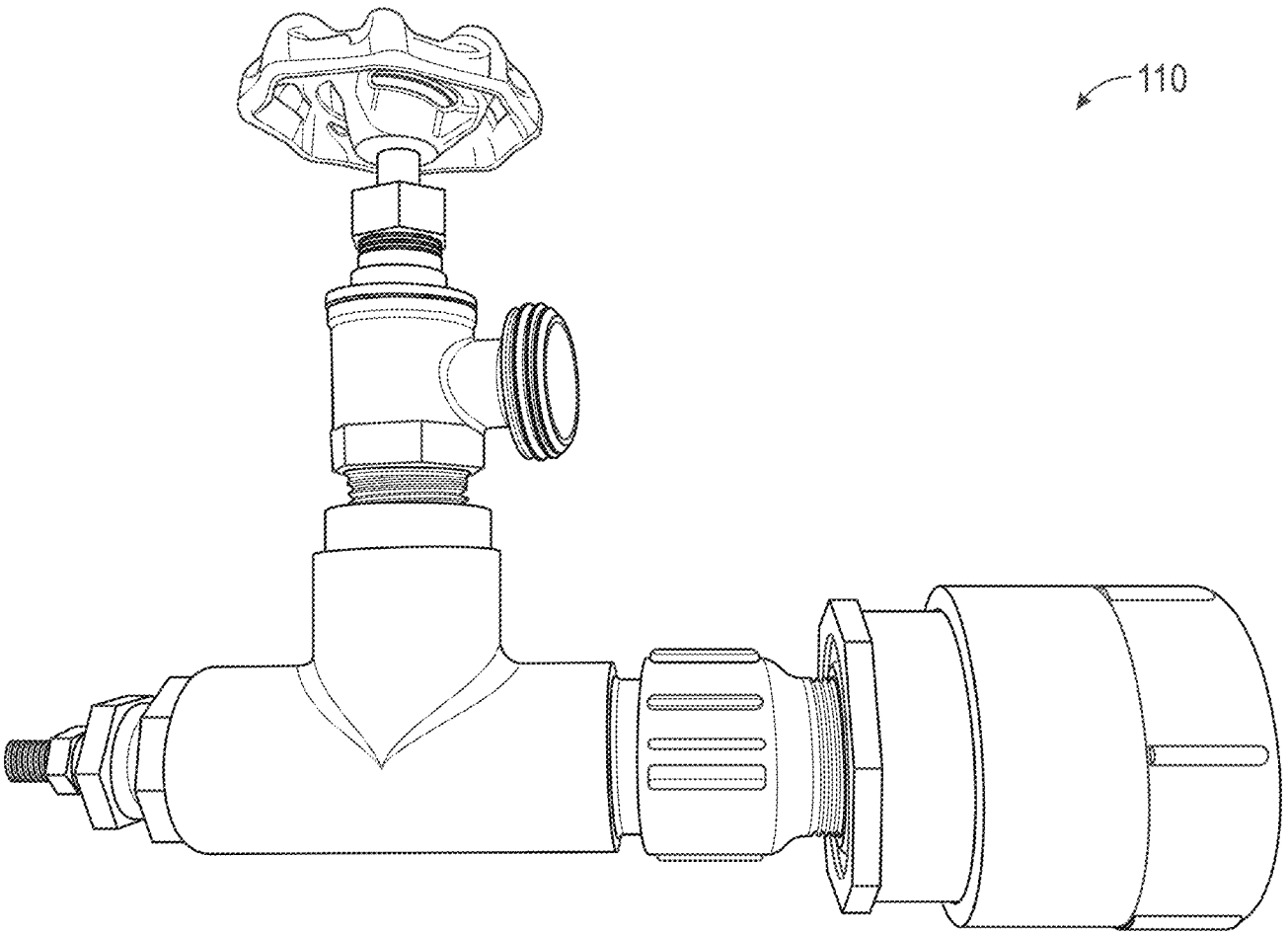
FIG. 2 is a more detailed perspective diagram illustrating a T-shaped tool of the plumbing tool of FIG. 1, according to an embodiment.

FIG. 1 is a high-level illustration of a plumbing system 100 for unclogging water drains with air-pressurized water, according to an embodiment. The plumbing tool 100 includes a T-shaped body 110, a water valve 120, an air valve 130, and a drain pipe connector. Additionally, the plumbing tool 100 includes a first inlet 101, a second inlet 102, a combined outlet 103, a screen and internal threading 105. Many variations are possible. The system 100 can be a sub-system of a bigger unclogging tool in some cases.

The plumbing system 100 is configured to connect by interrupting a water drain at a joint between a clogged portion and an unclogged portion. In other words, the T-shaped body 110 is temporarily installed to remove the clog. One alternative embodiment does not interrupt the water drain, but is installed permanently in-line with a water drain and is activated on an as-needed basis, either manually or remotely. Referring again to the T-shape, a water hose or other water supply is connected to the water valve 120. An air tank or other pressurized gas is connected to the air valve 130. In operation, a user sets the water and air levels as desired to clear a clog. The clogged drain pipe can be ½-inch in diameter, 2-inch, 6-inch, or other sizes. Pipes can be connected directly to an endpoint, such as a sink or bathtub, or connect downstream at a main sewer outlet. Pipes can be oriented vertically, horizontally or at any angle.

The T-shaped body 110 provides a mixing chamber for water and air to combine and produce pressurized water. A hollowed chamber along a first axis with a first inlet provides a path for variable air pressure to enter the clogged portion of the pipe through a combined outlet. A hollowed chamber along a second axis with a second inlet provides a path for water to enter the clogged portion of the pipe, after mixing with and consequentially being pressurized by, the compressed air. In general, compressed air is air kept under a pressure that is greater than atmospheric pressure. In a different embodiment, the first inlet is used for water and the second inlet for introducing the pressurized air from the second axis. Additionally, the T-shape can be 90 degrees or different angles and shapes to generate different combining actions (e.g., a K-shaped body with drain line in, water supply in, air supply in, and outlet). One tool has adjustable angles. The T-shaped body 110 can be composed from PVC material, plastic, rubber, metal, or a combination.

Pressurized water droplets are ejected through the combined outlet. Rather than a singular force pushing through, force is distributed over different points for a multi-faceted attack on the clog. In some non-limiting embodiments, screens can be added to the combined outlet to control a dispersion pattern. Different dispersion patters may apply different types of force to the clog. In one case, a first screen is used to start dislodging the clog, and a second screen is used to complete dislodging. The combined outlet can be stepped up or stepped down in size to match a pipe size.

The water supply can be from a water supply of a house, such as from a spigot for a water hose or a more powerful source. The hose connects to the water valve 120 via threads. The water supply can be, for example, 60 PSI to 80 PSI, as typically provided to residential homes or higher in commercial implementations. Hot water is applied in some cases, but cold water or warm water can also be used. In one case, the same water supply that provides water to a clogged sink can be used to clear the drain. The second inlet can be smaller in diameter for air than the first inlet for water.

Compressed gas or air can be supplied by, for example, a 6-gallon steel portable air compressor that plugs into an electrical outlet or runs on gasoline. For example, a 0.8 HP compressor may supply 150 psi to the plumbing system 100. In another example, a foot-actuated air pump provides compressed air. In one embodiment, an electronic controller adjusts air and/or water pressure automatically based on feedback during declogging.

II. Methods for Unclogging Drains (FIG. 3)

Figure 3:
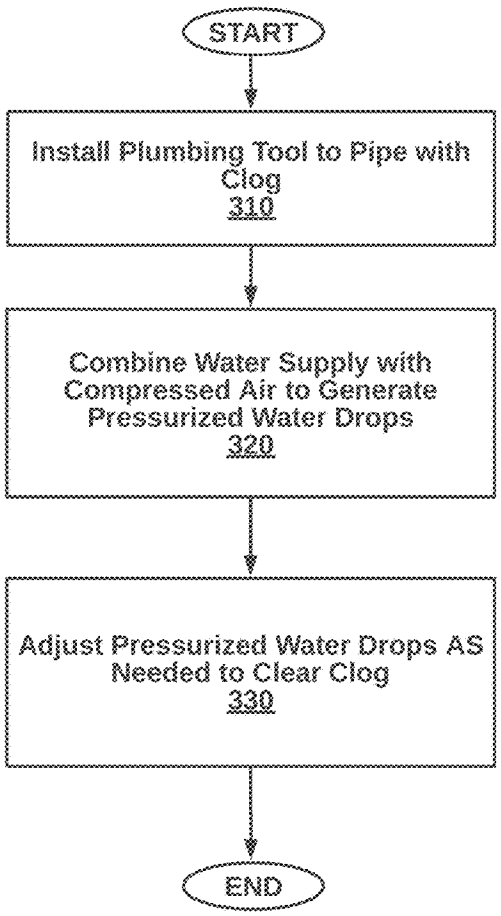
FIG. 3 is a high-level flow diagram illustrating a method for unclogging water drains with air-pressurized water, according to some embodiments.

FIG. 3 is a high-level flow diagram illustrating a method for unclogging water drains with air-pressurized water, according to one embodiment. The method 300 can be implemented, for example, by the system 100 of FIG. 1. The steps are merely representative groupings of functionality, as there can be more or fewer steps, and the steps can be performed in different orders. Many other variations of the method 300 are possible.

At step 310, a plumbing tool is installed to a pipe with a clog. In one example, a J-channel is temporarily removed from under a sink at its joints. The plumbing tool is then temporarily screwed onto the end of the pipe leading to the clog. Hoses are connected to an air supply and a water supply.

At step 320, a water supply is combined with compressed air to generate pressurized water drops. One embodiment includes a controller that balances air and water to a set ratio or pressure.

At step 330, pressurized water drops are adjusted as needed to clear the clog. A first screen can be changed to a second screen. Pressurized water can be gradually turned up or down during the unclogging process.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

We claim:

1. A compact plumbing tool for unclogging water drains inline with air-pressurized water, the plumbing tool consisting of:

a rigid T-shaped body with a hollowed cavity configured to intercept a drain line between a clogged portion and an unclogged portion;

a first inlet on the rigid T-shaped body configured to receive pressurized water directly from an external water line;

a second inlet on the rigid T-shaped body configured to receive pressurized air directly from an external mobile air source, the second inlet having a smaller diameter than the first inlet, wherein the pressurized air is mixed with the pressurized water in a chamber at an intersection of the T-shaped body to produce a pressurized air/water combination of air pressurized water droplets; and a combined outlet with threading for coupling the rigid T-shaped body directly to the clogged portion of the drain pipe using threading of the drain pipe, the combined outlet inline with the second inlet, to force the pressurized air/water combination directly into the clogged portion to clear the clogged portion of the drain, wherein the rigid T-shaped body, the first inlet, the second inlet and the combined outlet are monolithic.

2. The plumbing tool of claim 1, wherein the combined outlet is configured for use on a horizontally oriented drain line.

3. The plumbing tool of claim 1, wherein the combined outlet is configured for use on a vertically oriented drain line.

4. A method for using a compact plumbing tool for unclogging water drains inline with air-pressurized water, the method consisting of:

providing a rigid T-shaped body with a hollowed cavity configured to intercept a drain line between a clogged portion and an unclogged portion;

receiving pressurized water directly from an external water line at a first inlet on the rigid T-shaped body;

receiving pressurized air directly from an external mobile air source at a second inlet on the rigid T-shaped body, the second inlet having a smaller diameter than the first inlet, wherein the pressurized air is mixed with the pressurized water in a chamber at an intersection of the T-shaped body to produce a pressurized air/water combination of air pressurized water droplets; and forcing the pressurized air/water combination through a combined outlet with threading for coupling the rigid T-shaped body directly into the clogged portion of the drain pipe using threading of the drain pipe, the combined outlet being inline with the second inlet, to clear the clogged portion of the drain, wherein the rigid T-shaped body, the first inlet, the second inlet and the combined outlet are monolithic.

5. The method of claim 4, wherein the combined outlet is configured for use on a horizontally oriented drain line.

6. The method of claim 4, wherein the combined outlet is configured for use on a vertically oriented drain line.

* * * * *